United States Patent [19]

Spinner

[11] Patent Number: 4,568,898

[45] Date of Patent: Feb. 4, 1986

[54] SHORT-CIRCUIT DEVICE

[76] Inventor: Georg Spinner, Am Eichberg 12, 8152 Feldkirchen-Westerham, Fed. Rep. of Germany

[21] Appl. No.: 644,795

[22] Filed: Aug. 27, 1984

[30] Foreign Application Priority Data

Aug. 26, 1983 [DE] Fed. Rep. of Germany ..... 3330875

[51] Int. Cl.[4] ..... H01P 1/28

[52] U.S. Cl. ..... 333/263; 333/225

[58] Field of Search ..... 333/245, 263, 225

[56] References Cited

U.S. PATENT DOCUMENTS 2,407,147 9/1946 Fedotoff ..... 333/263 X 2,964,720 12/1960 Morrow et al. ..... 333/263

*Primary Examiner*—Paul Gensler

*Attorney, Agent, or Firm*—Henry M. Feiereisen

[57] ABSTRACT

A coaxial short-circuit device has an inner conductor which is surrounded by an outer conductor and is electrically connected to the latter by a shorting plunger. In order to allow the axial movement of the shorting plunger, the inner conductor accommodates a spindle which is connected in a force-locking manner to a first carriage arranged between the spindle and the inner conductor. A second carriage is arranged between the inner and the outer conductor and cooperates with the first carriage in such a manner that upon rotational movement of the spindle the first carriage is axially shifted along the spindle and this movement is transmitted to the second carriage and eventually to the shorting plunger which is connected to the second carriage in a force-locking manner. Transmitting the movement of the first carriage to the second carriage is provided by magnets respectively accommodated by the first and second carriages and polarized in an opposing manner so as to cause an attractive force between the carriages.

10 Claims, 1 Drawing Figure

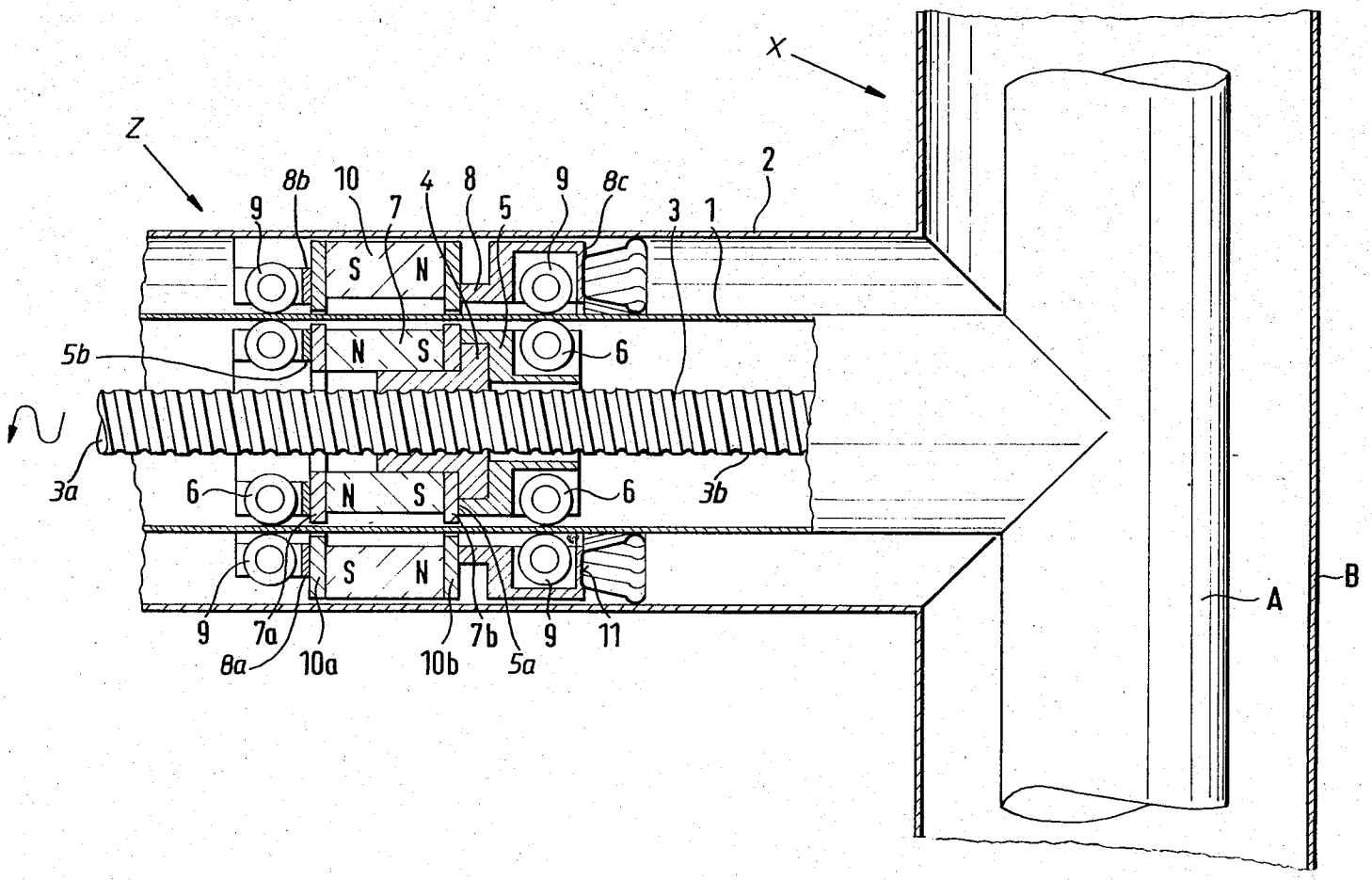
B
A
X
2
1
3
3b
8c
9
6
5
8
4
7
10
8b
9
Z
5b
3a
6
9
11
5a
7b
10b
10a
7a
8a
N
S

SHORT-CIRCUIT DEVICE

FIELD OF THE INVENTION

The present invention relates to a short-circuit device and in particular to a coaxial short-circuit device.

BACKGROUND OF THE INVENTION

In general such coaxial short-circuit devices have an inner and an outer conductor which are connected via a shorting plunger in an electrically conductive manner.

In a known short-circuit device, the shorting plunger is adjustable along a rod which is guided toward the outside. This arrangement has the drawback, however, that a considerable demand of space is required when using a shorting plunger which has a long adjusting path between two end positions in dependence on the electrical length of the conductor since the stroke of the rod outside the short-circuit device is equal to the maximum adjusting path of the shorting plunger.

It is also known to adjust the shorting plunger via a driving mechanism which is coaxially arranged with respect to a short-circuit device either inside or outside of the latter. The drive mechanism is connected with the shorting plunger through slots which are arranged in the inner or outer conductor.

The provision of such slots is disadvantageous since the characteristic impedance of the short-circuit device is altered and thus causes considerable high-frequency losses.

OBJECT OF THE INVENTION

It is thus the object of my invention to provide an improved short-circuit device obviating the aforestated drawbacks.

SUMMARY OF THE INVENTION

I realize this object, in accordance with the present invention, by providing a spindle within the inner conductor in such a manner that upon rotational movement thereof a first shifting element is axially moved along the spindle and this movement is transmitted to a second shift element to which the shorting element is connected and consequently shifted as well.

The short-circuit device according to my invention provides for the shorting plunger a drive mechanism which does not interfere with the electric features or characteristics of the short-circuit device and additionally reduces the demand of space considerably in comparison with prior art constructions.

According to the teachings of my invention, the movement of the first shift element is transmitted to the second shift element by cooperating annular magnets which are polarized in an opposing manner to provide an attractive force between the two shift elements. Therefore, a noncontacting connection is obtained between the two shift elements.

BRIEF DESCRIPTION OF THE DRAWING

The above and other features of my present invention will now be described in detail with reference to the accompanying drawing in which:

the sole FIGURE illustrates a coaxial short-circuit device according to the invention attached to an exemplified coaxial cable.

SPECIFIC DESCRIPTION

In the sole FIGURE, I have illustrated a coaxial cable X having an outer conductor B completely surrounding an inner conductor A. The inner and outer conductors A,B are thus coaxially arranged and are insulated from each other e.g. by a continuous solid dielectric or by dielectric spacers (not shown).

In order to provide a short circuit i.e. a connection between the inner conductor A and the outer conductor B, the coaxial cable X is associated with a short-circuit device Z whose electrical length is adjustable. The short-circuit device Z is connected to the coaxial cable X in form of a stub line which branches or projects from the coaxial cable X e.g. at an angle of 90°.

The short-circuit device Z has a hollow inner conductor 1 branching off from and being integral with the inner conductor A of the coaxial cable X and an outer conductor 2 which is integrally connected with the outer conductor B and concentrically surrounds the inner conductor 1. Pivotally suppoted and centered within the hollow conductor 1 is a threaded spinlde 3 which projects beyond the short-circuit device Z i.e. beyond the coaxial arrangement of the conductors 1,2 so as to allow actuation of the spindle 3 from the outside either manually or by a suitable drive mechanism (not shown) in order to rotate the spindle 3. I may note that the support of the spindle 3 can be of any suitable manner and does not form part of the invention so that an illustration thereof has been omitted.

The spindle 3 consists of a shaft **3*a* extending axially within the conductor 1 and a thread 3*b* provided along the circumference of the shaft 3*a*. Cooperating with the thread 3*b* is a L-shaped nut 4 which depending on the rotation of the spindle 3 slides in axial direction along the shaft 3*a* toward or away from the coaxial cable X. In order to provide reduced friction and an exact guidance of the nut 4, the threaded spindle 3** is preferably a ball-screw with a suitable nut.

The nut 4 cooperates in a force-locking manner with a shift sleeve 5 which is designed in the shape of a carriage and is provided at its opposing front ends with rollers 6 so as to allow the sleeve 5 to run along the inner side of the conductor 1. Located in a space **5*a*, the sleeve 5 accommodates an annular magnet 7 which is kept in its position by a clamping element 5*b*. The magnet 7 is polarized in axial direction and is provided with an annular pole shoe 7*a*;7*b* at each end face thereof. Each pole shoe 7*a*,7*b* projects toward the inner side of the conductor 1 so that the respective outer circumference is in the vicinity of the conductor 1**.

Arranged coaxially to the shift sleeve 5 and located between the inner conductor 1 and the outer conductor 2 is a second shift sleeve 8 which is also shaped in form of a carriage and is provided with rollers 9 at the opposing front ends. The sleeve 8 thus runs along the outer side of the inner conductor 1. In a space **8*a*, the sleeve 8 accommodates an annular magnet 10 which coaxially surrounds the magnet 7 and is kept in its position by a clamping element 8*b*. The magnet 10 has at each respective end face an annular pole shoe 10*a*; 10*b* each of which projecting toward the outer side of the inner conductor 1 in such a manner that the respective inner circumference is in the vicinity of the conductor 1. In order to provide an attractive force between the magnets 7 and 10 and to transmit the movement of the sleeve 5 to the sleeve 8, the magnet 10 has an inverted polarization with respect to the magnet 7** i.e. the magnets 7 and 10 oppose each other in such a manner that a south pole opposes a noth pole.

The front end 8*c* of the sleeve 8 which end faces the coaxial cable X is connected in a force-locking manner with a shorting plunger 11. The shorting plunger 11 can be of any suitable structure and e.g. in the present embodiment includes two laminated spring washers integrally connected with each other. One of the spring washers contacts the outer conductor 2 while the other spring washer is in contact with the inner conductor 1.

Consequently, when the spindle 3 is actuated, the nut 4 is shifted along the shaft 3*a* thereby taking along the sleeve 5. Due to the attractive force between the magnets 7 and 10, the sleeve 8 is moved as well and thus shifts the shorting plunger 11 accordingly. Therefore, transmitting of the movement between the sleeves 5 and 8 is obtained without providing a contact therebetween and is based solely on the force-locking connection of the spindle 3 and the sleeve 5 and the arrangement of the magnets 7 and 10 having opposite polarization. The attractive force is obtained through the inner conductor 1 whose wall is made of nonmagnetic material.

I claim:

1. A short-circuit device, comprising:

an inner conductor;

an outer conductor surrounding said inner conductor;

an adjustable shorting plunger connecting said inner conductor with said outer conductor in an electrically conductive manner; and actuating means for moving said shorting plunger with respect to said inner and outer conductors, said actuating means including a spindle pivotally centered within said inner conductor, a first shift element connected to said spindle and being shiftable in response to a rotational movement of said spindle, a second shift element connected to said shorting plunger, and magnetic means for transmitting a movement of said first shift element to said second shift element so as to provide adjustment of said shorting plunger.

2. A device as defined in claim 1 wherein said actuating means further includes a nut threaded on and axially movable along said spindle, said nut being connected with said first shift element in a force-locking manner.

3. A device as defined in claim 2 wherein said magnetic means includes a first annular magnet accommodated by said first shift element and a second annular magnet accommodated by said second shift element, said first and second magnets facing each other and being arranged with opposing polarization so as to provide an attractive force therebetween.

4. A device as defined in claim 3 wherein said second magnet coaxially surrounds said first magnet.

5. A device as defined in claim 1 wherein said spindle is arranged within said inner conductor at a field-free location of said shorting plunger and projects beyond said inner and outer conductors to allow actuation of said spindle from outside.

6. A device as defined in claim 1 wherein said shorting plunger is connected to said second shift element in a force-locking manner.

7. A device as defined in claim 1 wherein said first shift element is arranged between said spindle and said inner conductor, and said second shift element is provided between said inner and outer conductors.

8. A device as defined in claim 3 wherein each of said magnets includes a pole shoe at opposing ends thereof, each of said pole shoes having a circumference projecting toward said inner conductor so as to extend in vicinity of said inner conductor.

9. A device as defined in claim 1 wherein said inner conductor has an inner side and an outer side, said first and second shift elements each being a carriage provided with rollers at each respective front end thereof so that said first shift element runs along said inner side of said inner conductor and said second shift element runs along said outer side of said inner conductor.

10. A device as defined in claim 1 wherein said spindle is designed as a ball screw.

* * * * *